US008657076B2

(12) United States Patent
Beaudry

(10) Patent No.: US 8,657,076 B2
(45) Date of Patent: Feb. 25, 2014

(54) VIBRATION ISOLATOR FOR THE SLIDING RAIL GUIDE OF AN ELEVATOR OR THE LIKE

(75) Inventor: Bruce F. Beaudry, Bloomington, IN (US)

(73) Assignee: Otis Elevator Company, Farmington, CT (US)

( * ) Notice: Subject to any disclaimer, the term of this patent is extended or adjusted under 35 U.S.C. 154(b) by 940 days.

(21) Appl. No.: 12/597,709

(22) PCT Filed: Apr. 27, 2007

(86) PCT No.: PCT/US2007/010349

§ 371 (c)(1),
(2), (4) Date: Oct. 26, 2009

(87) PCT Pub. No.: WO2008/133622

PCT Pub. Date: Nov. 6, 2008

(65) Prior Publication Data

US 2010/0065382 A1 Mar. 18, 2010

(51) Int. Cl.
*B66B 7/04* (2006.01)

(52) U.S. Cl.
USPC ..... 187/409

(58) Field of Classification Search
CPC ..... B66B 7/042; B66B 7/048; B66B 7/047
USPC ..... 187/409; 104/124–127, 242, 247; 254/277, 392, 393; 188/378, 379, 107, 188/136; 267/140.11, 140.5, 141, 141.1, 267/257, 258, 292

IPC ..... B66B 7/04
See application file for complete search history.

(56) References Cited

U.S. PATENT DOCUMENTS

| | | | | | |
|---|---|---|---|---|---|
| 1,907,966 | A | * | 5/1933 | Henry | 187/409 |
| 2,103,480 | A | | 12/1937 | Mason | |
| 2,490,652 | A | | 12/1949 | Sahlin | |
| 3,409,284 | A | * | 11/1968 | Rix | 267/153 |
| 3,554,327 | A | | 1/1971 | Takamura et al. | |

(Continued)

FOREIGN PATENT DOCUMENTS

| | | |
|---|---|---|
| DE | 1 800 485 | 5/1969 |
| DE | 39 19 850 | 12/1989 |

(Continued)

OTHER PUBLICATIONS

EPO Machine Translation, EP0588679, Dec. 17, 2012, pp. 4.*

(Continued)

*Primary Examiner* — Michael Mansen
*Assistant Examiner* — Stefan Kruer
(74) *Attorney, Agent, or Firm* — Kinney & Lange, P.A.

(57) ABSTRACT

An elevator car sliding guide includes a shoe configured to slide on one or more rails, a first bracket connected to the shoe, a second bracket for connecting to a car assembly, and a plurality of elongated elastomeric members arranged generally from a first end of the sliding guide to a second end of the sliding guide and connected between the first bracket and the second bracket. The shoe and the first bracket are substantially surrounded on three sides by the second bracket. Each of the plurality of elongated elastomeric members is configured for deflection under loads of increasing magnitude.

13 Claims, 6 Drawing Sheets

(56) References Cited

U.S. PATENT DOCUMENTS

| | | | | |
|---|---|---|---|---|
| 4,216,846 | A * | 8/1980 | Wheeler | 187/409 |
| 4,271,932 | A | 6/1981 | Klein | |
| 4,598,798 | A | 7/1986 | Koppensteiner | |
| 4,752,058 | A | 6/1988 | Weber | |
| 2008/0156310 | A1 * | 7/2008 | Leven | 124/89 |

FOREIGN PATENT DOCUMENTS

| | | | | |
|---|---|---|---|---|
| EP | 588679 | A1 * | 3/1994 | F16F 7/12 |
| FR | 2 402 616 | | 4/1979 | |
| FR | 2 558 815 | | 2/1985 | |
| JP | 4912280 | | 2/1974 | |
| JP | 52116550 | A | 9/1977 | |
| JP | 60183482 | A | 9/1985 | |
| JP | 63199937 | A | 8/1988 | |
| JP | 9227055 | A | 9/1997 | |
| JP | 2004217407 | A * | 8/2004 | B66B 7/04 |
| JP | 2004250127 | A * | 9/2004 | B66B 7/04 |
| JP | 2008007248 | A * | 1/2008 | B66B 7/04 |

OTHER PUBLICATIONS

EPO Machine Translation, DE3919850, Dec. 17, 2012, pp. 4.*

Patent & Utility Model Gazette Translation, JP2004217407, Dec. 17, 2012, pp. 6.*

The Japanese Office Action translation dated Mar. 6, 2012 for Japan Patent Application No. 2010-506157.

International Search Report & Written Opinion—PCT/US2007/010349—Dated Feb. 21, 2008—12 pages.

Eugene I. Rivin, "Vibration Isolation of Precision Objects," Sound and Vibration/Jul. 2006, p. 12-20.

English Translation of Chinese Office Action, issued Jul. 26, 2013.

* cited by examiner

VIBRATION ISOLATOR FOR THE SLIDING RAIL GUIDE OF AN ELEVATOR OR THE LIKE

BACKGROUND

The present invention relates to sliding guides used in elevator systems. More particularly, the invention relates to a sliding guide vibration isolator.

Elevator cars are commonly guided along rails in a hoistway by sliding guides. In elevator systems including sliding guides, it has been a frequent practice to interpose an elastomeric material between the car and the guide which slides against the rail. This is done in an attempt to reduce the transmission of mechanical vibration and acoustical noise into the car and its passengers.

Prior sliding guides including elastomeric vibration isolating arrangements have several disadvantages. The stiffness of such sliding guides is too high for effective vibration and acoustic noise reduction, despite the use of elastomeric material between the car and rail sides of the device. The weight of the car and its associated load has a center of gravity whose location varies depending on the number of passengers and their locations within the car. This creates significant side-to-side forces which the sliding guides must transmit to the rails. In addition, the horizontal distance between the rails varies slightly along the height of the hoistway due to installation tolerances. Such rail imperfections also affect the forces applied to the sliding guides. These forces vary and so cannot be accommodated by a low stiffness isolator, which could provide useful amounts of vibration and acoustic noise reduction. This situation necessitates a higher stiffness mounting design, which affords little sound and vibration reduction in the lower frequency range. Unfortunately, the lower frequency range contains significant vibration and acoustic noise energy which is objectionable in the car.

In prior sliding guides, the elastomeric material is constrained over most of its surface by either the sliding guide or the supporting bracket which is attached to the car. Only a small fraction of the elastomer's surface area is exposed to the air where it would be free to "bulge out" under the action of forces applied to the guide. As the elastomers frequently used are incompressible, the only way for the guide to move relative to the supporting bracket is for the entire volume of elastomer to "flow" towards the exposed edges to "bulge out". As a consequence of a small area through which the elastomer is free to bulge, the stiffness of this arrangement is often much higher than the stiffness needed for the significant reduction of vibration and acoustic noise. Instead of a highly constrained elastomer, some prior sliding guides use a resilient element, such as a mechanical spring. In either case, these materials provide little or no dynamic mechanical isolation and damping, resulting in poor vibration and acoustic noise reduction in some frequency ranges due to the interaction of lightly damped (and thus high amplitude) mechanical resonances in the car, rail, sliding guide and elevator system structures and materials.

In light of the foregoing, the present invention aims to resolve one or more of the aforementioned issues that afflict elevator systems.

SUMMARY

The present invention includes an elevator car sliding guide including a shoe configured to slide on one or more rails, a first bracket connected to the shoe, a second bracket for connecting to a car assembly, and a plurality of elongated elastomeric members arranged generally from a first end of the sliding guide to a second end of the sliding guide and connected between the first bracket and the second bracket. The shoe and the first bracket are substantially surrounded on three sides by the second bracket. Each of the plurality of elongated elastomeric members is configured for deflection under loads of increasing magnitude.

Embodiments of the present invention also include an elevator system comprising a car, a frame connected to the car, one or more rails, and one or more sliding guides connected to the frame and slidably connected to at least one of the one or more rails. Each of the one or more sliding guides includes a plurality of elastomeric members arranged generally from a first end of the sliding guide to a second end of the sliding guide and connected between a bracket connected to the frame and a shoe slidably connected to the least one of the one or more rails. Each of the elastomeric members is configured for deflection under loads of increasing magnitude.

It is to be understood that both the foregoing general description and the following detailed description are exemplary and explanatory only, and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are hereafter briefly described.

DETAILED DESCRIPTION

Figure 1:
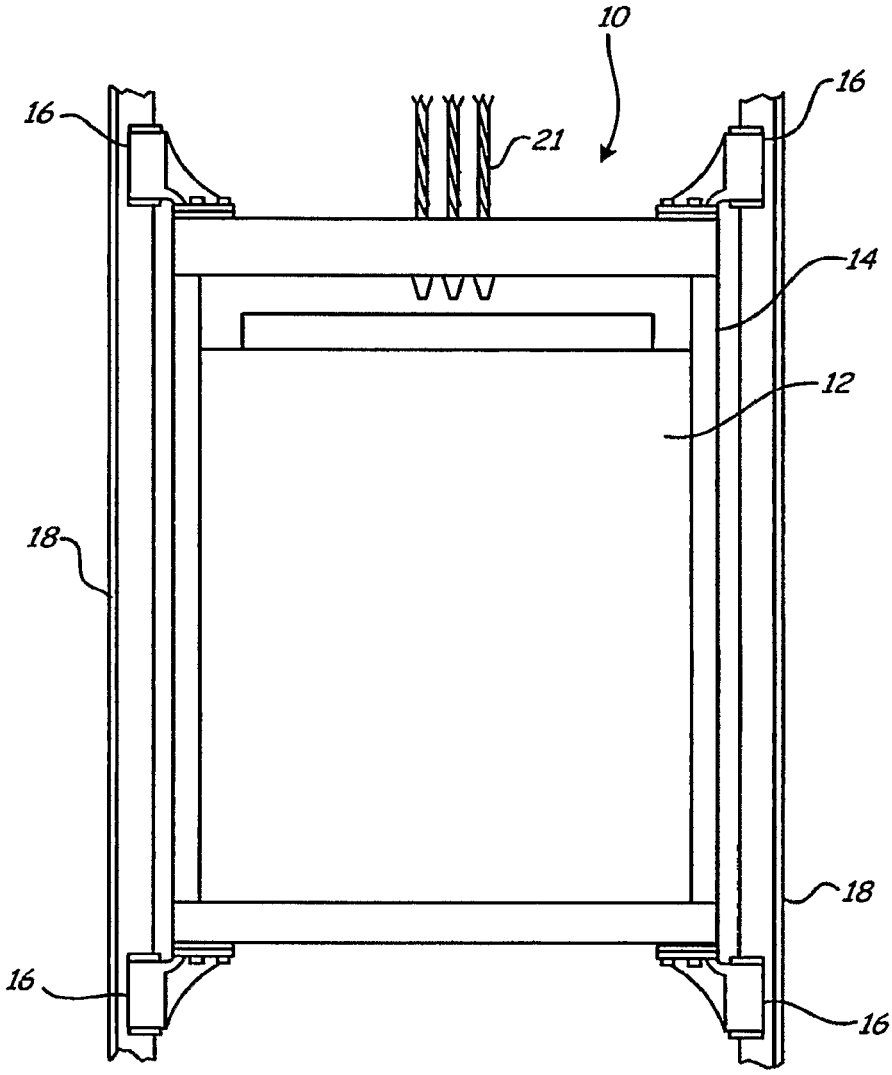
FIG. 1 is a side view of an embodiment of an elevator system including sliding guides according to the present invention.

Efforts have been made throughout the drawings to use the same or similar reference numerals for the same or like components.

FIG. 1 is a side view of an elevator system 10 including a car 12, a frame 14, sliding guides 16, rails 18, and tension members 21, such as belts or cables. In FIG. 1, the frame 14 is attached to the car 12. Four sliding guides 16 are connected to the frame 14, and thereby to the car 12, at the corners of the frame 14 and are movably connected to the rails 18. The number and location of the sliding guides 16, and the connection between the sliding guides 16 and the car 12 may vary across different embodiments of the present invention. For example, in another embodiment of the present invention the elevator system may include two sliding guides 16 positioned directly between the top of the car 12 and the rails 18. The tensions members 21 in FIG. 1 are commonly connected to a drive system (not shown), for example a hoisting machine, which drives the car 12 and the frame 14 up and down a hoistway (not shown) along the rails 18 via the sliding guides 16. The sliding guides 16 may be configured to provide a low friction connection to the rails 18 and may also act to damp vibration and structure-borne noise transmitted through system 10 to the frame 14, and thereby the car 12.

Figure 2:
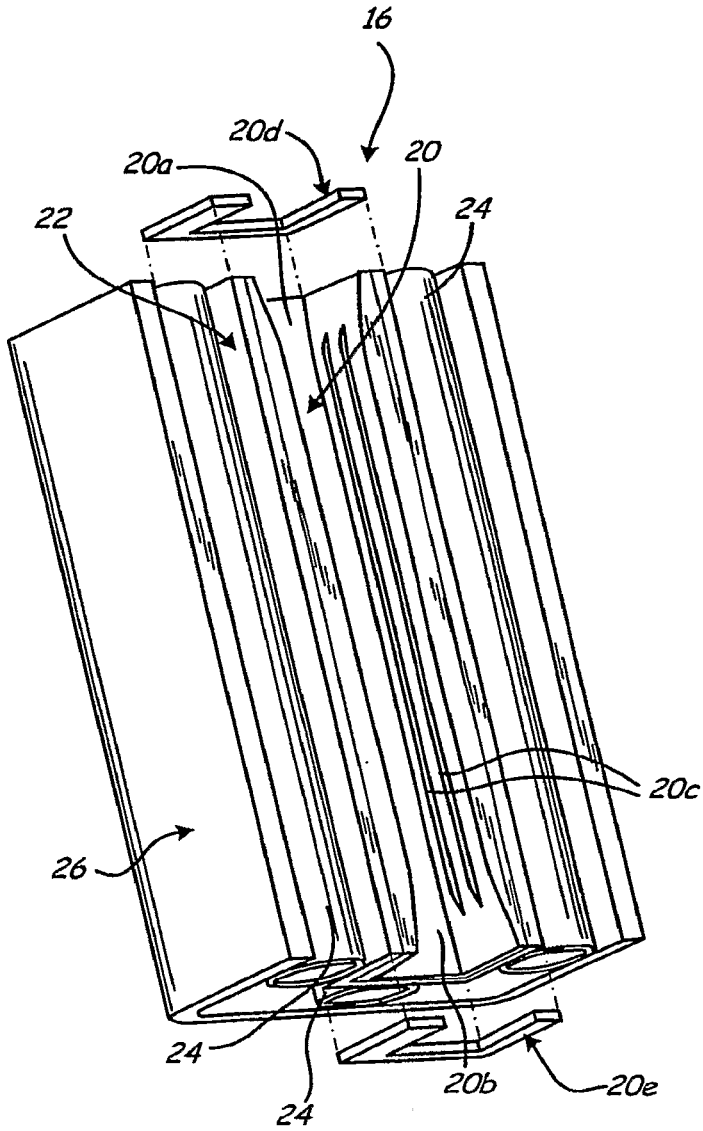
FIG. 2 is a perspective view of one of the sliding guides of FIG. 1.
Figure 3:
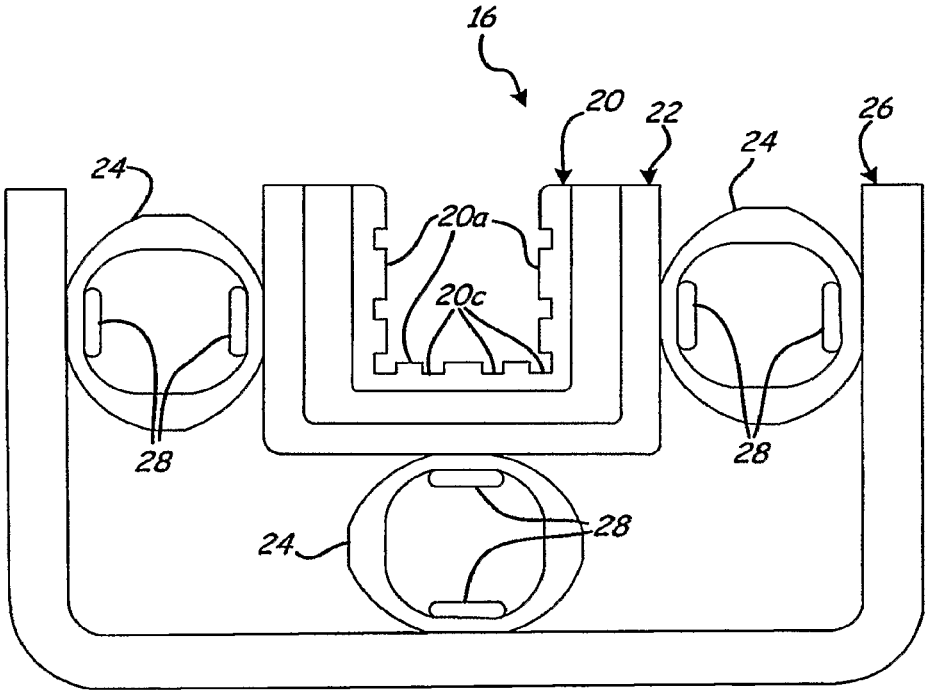
FIG. 3 is a top view of the sliding guide of FIG. 2 with a wiper removed for clarity.

FIGS. 2 and 3 are a perspective and a top view respectively showing one of the sliding guides 16 of FIG. 1, which includes a shoe 20, a first connecting member 22 (hereinafter referred to as a "first bracket 22"), elastomeric members 24, a second connecting member 26 (hereinafter referred to as a "second bracket 26"), and bar clamps 28. The shoe 20, sometimes referred to as a "gib," includes a tapered top, first end 20*a*, a tapered bottom, second end 20*b*, grooves 20*c*, a top, first wiper 20*d*, and a bottom, second wiper 20*e*. As shown in FIGS. 2 and 3, the shoe 20 and the first and second brackets 22, 26, may each have a generally U-shaped cross-section. The shoe 20 is attached to and arranged inside the first bracket 22. The first bracket 22 is spaced from and arranged generally inside the second bracket 26. The elastomeric members 24 are connected lengthwise, for example generally from a top, first end of the sliding guide 16 to a bottom, second end of the sliding guide 16, between the first bracket 22 and the second bracket 26 by the bar clamps 28. The connection between the elastomeric members 24 and the first and second brackets 22, 26 may vary across different embodiments of the present invention. For example, the elastomeric members 24 may be attached to the first and second brackets 22, 26 by an industrial epoxy with a broad operating temperature range. Alternatively, the elastomeric members 24 may be attached to the first and second brackets 22, 26 by threaded or unthreaded fasteners, such as screws or rivets. In another embodiment, the connection between the elastomeric members 24 and the first and second brackets 22, 26 may be accomplished by press fitting slots in the outer walls of the elastomeric members 24 over interlocking tabs integral with the first and second brackets 22, 26. Each of the plurality of elastomeric members 24 is connected between first bracket 22 and second bracket 26 by press fitting a plurality of interlocking tabs on first bracket 22 and second bracket 26 into a plurality of slots in each of the plurality of elastomeric members 24.

In FIGS. 2 and 3, the shoe 20 may have a generally U-shaped cross-section with three interior bearing surfaces configured to provide a sliding connection to one or more rails 18 (shown in FIG. 1). The interior surfaces of the shoe 20 may be configured, as shown in FIGS. 2 and 3, with the tapered first end 20*a*, the tapered second end 20*b*, and one or more grooves 20*c*. The tapered first and second ends 20*a*, 20*b* may be adapted to provide a graduated connection between the shoe 20 and the rail 18, which graduated connection may act to lower the frequency range of the mechanical shock spectrum and smooth the effect of rail imperfections caused by, for example, discontinuities at rail segment joints or brake gouges in the rail. The grooves 20*c* in the bearing surfaces of the shoe 20 may act to reduce vibration and acoustic noise in the car 12 by providing clearance for, and entrapping, metal particles and debris generated during elevator installation and in-service wear. Two of the grooves 20*c* located at the interior corners of the generally U-shaped shoe 20 may also provide clearance for burrs on the edges of the rails 18 shown in FIG. 1. The number, size, shape, and placement of the grooves 20*c* on the shoe 20 may vary across different embodiments of the present invention. The shoe 20 may also include the first and second wipers 20*d*, 20*e* shown in FIG. 2, which may be configured to reduce the amount of material entrapped between the bearing surfaces of the shoe 20 and the rails 18 shown in FIG. 1 by wiping the surfaces of the rails 18 before the bearing surfaces of the shoe 20 contact the rails 18. The first and second wipers 20*d*, 20*e*, of FIG. 2 have been omitted from FIG. 3 for clarity.

The shoe 20 may be manufactured by commonly known techniques, such as injection molding. The shoe 20 may be constructed from a low friction material, including polyoxymethylene (also referred to as polytrioxane, acetal resin, and polyformaldehyde), polytetrafluoroethylene, and polyethylene. Moreover, the material for the shoe 20 may be resistant to oil and grease. The first and second wipers 20*d*, 20*e* of the shoe 20 may be made from, for example, felt or may include bristles either of which may act to wipe the surfaces of the rails 18 as the sliding guide 16 travels up and down along the rails 18.

The elastomeric members 24 of the sliding guide 16 shown in FIGS. 2 and 3 may be configured to provide vibration isolation and damping between the car 12 and the rails 18 (shown in FIG. 1). For example, the sliding guide 16 including the elastomeric members 24 may act to isolate and absorb side-to-side and front-to-back vibration of the car 12 imparted by the rails 18 during vertical travel of the car 12 along the rails 18. The elastomeric members 24 connected between the first and second brackets 22, 26 may be generally tubular with a generally octagonal tube cross-section having a contoured tube wall of varying thickness. As illustrated in FIGS. 2 and 3, a large percentage of the surface area of the elastomeric members 24 is unconstrained by the connection between the first and second brackets 22, 26. The elastomeric members 24 may act to isolate and damp vibrations from reaching the car 12, as each of the elastomeric members 24 is substantially free to deflect, for example by bulging or bending.

Figure 4A:
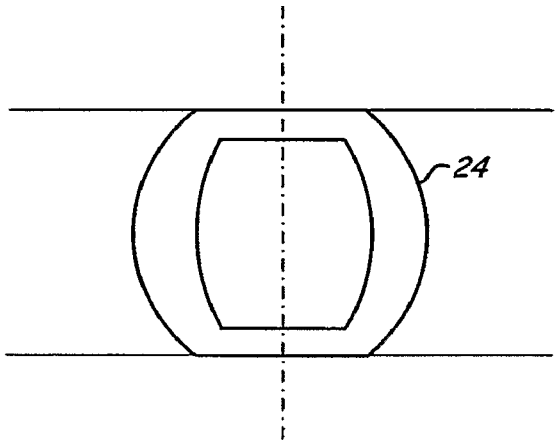
FIGS. 4A-4C are sectional views showing the deflection of one elastomeric member under increasing loads on the sliding guide of FIGS. 2 and 3.
Figure 4B:
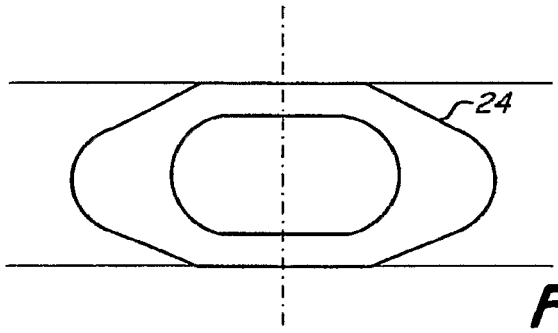
Figure 4C:
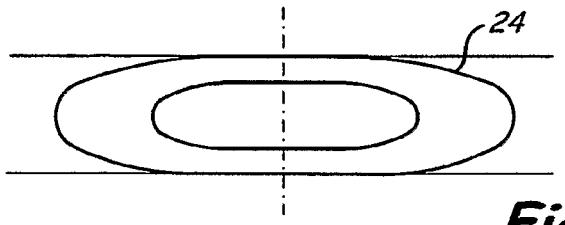

FIGS. 4A-4C illustrate the deflection of one of the elastomeric members 24 under increasing loads on the sliding guide 16 of FIGS. 2 and 3. Deflection of the elastomeric members 24 may be through a combination of bending followed by compression, as the sliding guide 16 is subjected to forces and vibrations transmitted through the rails 18. For example, in FIG. 4A, the elastomeric member 24 is at the rest position with no load applied. In FIG. 4B, a load begins to push the shoe 20, and thereby the first bracket 22, toward the elastomeric member 24. The elastomeric member 24 is shaped, such that the side walls, i.e. the walls unconstrained by the connection to the first and second brackets 22, 26, are thinner toward the ends thereof and thicker in the middle thereof. In this configuration, the elastomeric member 24, under a load, may initially bend at the corners as illustrated in FIG. 4B. As the load on the elastomeric member 24 increases in FIG. 4C, the bending mode may end as the thicker middle portion of the side walls of the elastomeric member 24 reach a compression mode.

Figure 5:
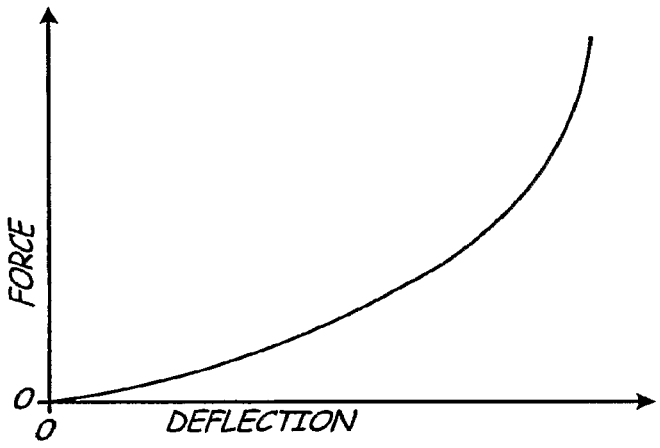
FIG. 5 is a graph of force versus deflection for the elastomeric member of FIGS. 4A-4C.

FIG. 5 is a graph showing force versus deflection for the elastomeric member 24 of FIGS. 4A-4C. The material of the elastomeric member 24 is substantially incompressible. The deflection of the elastomeric member 24 under increasing loads may begin with bending, but eventually may reach a compression mode at which point the inner surfaces of the elastomeric member 24 touch each other and may act to substantially inhibit, or snub, further deflection. The combination of bending and compression modes of the elastomeric member 24 results in a non-linear force versus deflection characteristic. The slope of the force versus deflection curve of the elastomeric member 24 is equal to the stiffness of the elastomeric member 24. Therefore, a corollary to the non-linear force versus deflection characteristic is that the stiffness increases with increasing force for the elastomeric member 24. The stiffness of the elastomeric members 24, and thereby of the guide 16, may increase only to the amount necessary to constrain the car 12 against the applied forces at any given time, thereby significantly increasing the amount of vibration and structure-borne noise isolation and damping and also the length of time over which the isolation and damping occurs. Additionally, the contoured tube cross-sectional shape of the elastomeric member 24 may provide a self-snubbing characteristic, which acts to constrain the car 12 under the influence of high forces by substantially eliminating further deflection as the elastomeric member 24 reaches the compression mode at and above forces of a prescribed magnitude.

Figure 6A:
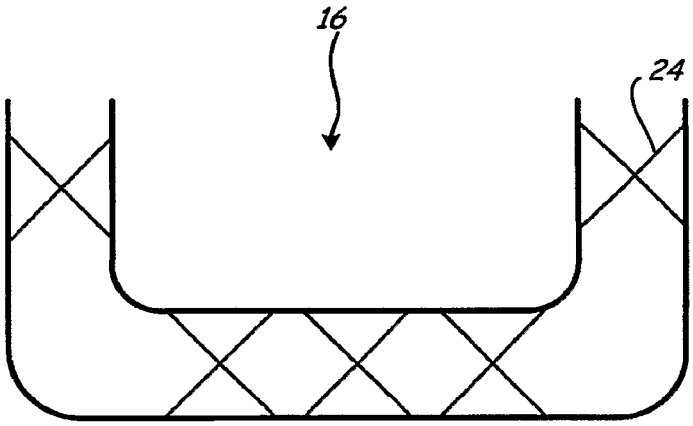
FIGS. 6A and 6B are each schematic top views of alternative embodiments of a sliding guide according to the present invention.
Figure 6B:
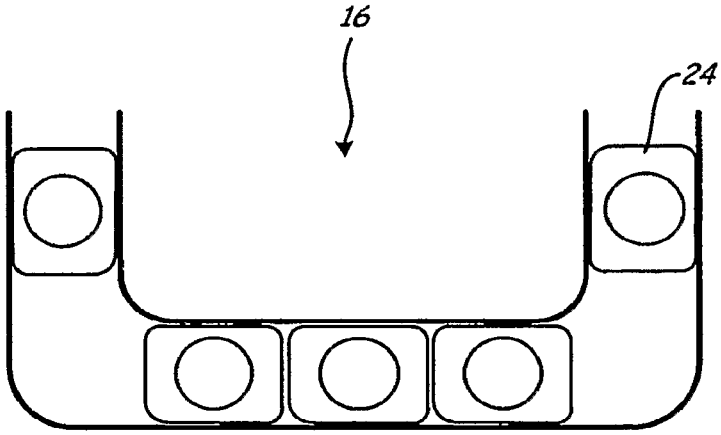

The number and shape of the elastomeric members 24 may vary across different embodiments of the present invention. For example, more than three elastormeric members may be connected between the first and second brackets 22, 26 of the sliding guide 16. FIG. 6A is a schematic top view showing an alternative embodiment of the sliding guide 16 including a plurality of elastomeric members 24 with a generally truss shaped cross-section including two crossed legs. FIG. 6B is a schematic top view of another embodiment of the sliding guide 16 including a plurality of elastomeric members 24 with tube-shaped cross-sections including a generally rectangular outer wall and a generally circular inner wall.

Embodiments of the present invention provide several advantages over prior sliding guides and elevator systems including sliding guides. The elastomeric members of sliding guides according to the present invention may be configured and arranged to produce a combination of bending and compression modes, which produces a non-linear force versus deflection characteristic. The non-linear force versus deflection characteristic of the elastomeric members in turn provides a self-adjusting dynamic stiffness for varying loading forces encountered in elevator service, thereby significantly increasing the amount of vibration isolation and damping and also the length of time over which the isolation and damping occurs. The cross-sectional shape of the elastomeric members may provide a self-snubbing characteristic acting to constrain the car under the influence of high forces. The shape and stiffness properties of the elastomeric members may be configured for specific applications to provide levels of vibration and acoustic noise reduction, which, in prior elevator systems, has required wheeled rolling guides with spring elements and damping devices. The simpler sliding guides of the present invention can significantly lower the cost and complexity of elevator systems that include conventional rolling and sliding guides. The tapered top and bottom of shoes used in sliding guides according to the present invention reduce the vibration and shock transmitted to the car from rail irregularities. Grooves in the shoe bearing surface provide clearance for debris and metal particles, reducing vibration, acoustic noise and frequency of shoe replacement. Additionally, grooves in the interior corners of the shoe provide clearance for burrs and nicks along the rail edge.

The aforementioned discussion is intended to be merely illustrative of the present invention and should not be construed as limiting the appended claims to any particular embodiment or group of embodiments. Thus, while the present invention has been described in particular detail with reference to specific exemplary embodiments thereof, it should also be appreciated that numerous modifications and changes may be made thereto without departing from the broader and intended scope of the invention as set forth in the claims that follow.

The specification and drawings are accordingly to be regarded in an illustrative manner and are not intended to limit the scope of the appended claims. In light of the foregoing disclosure of the present invention, one versed in the art would appreciate that there may be other embodiments and modifications within the scope of the present invention. Accordingly, all modifications attainable by one versed in the art from the present disclosure within the scope of the present invention are to be included as further embodiments of the present invention. The scope of the present invention is to be defined as set forth in the following claims.

The invention claimed is:

1. An elevator car sliding guide comprising:

a shoe configured to slide on one or more rails;

a first bracket connected to the shoe;

a second bracket configured to connect to a car assembly; and a plurality of elongated elastomeric members arranged generally from a first end of the sliding guide to a second end of the sliding guide and connected to the first bracket along a first wall and to the second bracket along a second wall;

wherein the shoe and the first bracket are substantially surrounded on three sides by the second bracket;

wherein each of the plurality of elongated elastomeric members is configured for deflection under loads of increasing magnitude; and wherein one or more of the plurality of elongated elastomeric members is generally tubular, and wherein:

(i) each of the generally tubular elastomeric members has a generally rounded-octagonal, tube-shaped cross-section with a contoured tube wall of varying thickness; or (ii) each of the generally tubular elastomeric members has a tube-shaped cross-section comprising:

a generally convex third wall; and a generally convex fourth wall; and wherein each of the third and fourth walls has a varying wall thickness, wherein the wall thickness of each of the third and fourth walls is thinner toward respective ends of each of the third and fourth walls and thicker in a respective middle of each of the third and fourth walls; or (iii) each of the generally tubular elastomeric members has a tube-shaped cross-section with a generally rectangular outer wall and a generally circular inner wall.

2. The guide of claim 1, wherein each of the shoe, first bracket and second bracket have a generally U-shaped cross-section; and wherein the shoe is arranged inside the first bracket and the first bracket is arranged inside and spaced from the second bracket.

3. The guide of claim 2, wherein the plurality of elongated elastomeric members comprises:

three elongated elastomeric members; and wherein each of the three elongated elastomeric members is respectively arranged in the space between each of the three adjacent legs of the generally U-shaped first bracket and the generally U-shaped second bracket.

4. The guide of claim 1, wherein each of the plurality of elongated elastomeric members is configured for deflection beginning with either a bending mode or a compression mode, and substantially ending when either the respective compression mode or the bending mode is reached.

5. The guide of claim 1 wherein each of the plurality of elastomeric members is connected between the first bracket and the second bracket by a plurality of fasteners selected from a group of fasteners consisting of screws and rivets.

6. An elevator car sliding guide comprising:

a shoe configured to slide on one or more rails;

a first bracket connected to the shoe;

a second bracket for connecting to a car assembly; and a plurality of tubular elastomeric members arranged generally from a first end of the sliding guide to a second end of the sliding guide and connected between the first bracket and the second bracket, each of the plurality of tubular elastomeric members having a tube-shaped cross-section comprising:

a first wall connected to the first bracket;

a second wall connected to the second bracket;

a generally convex third wall; and a generally convex fourth wall;

wherein the shoe and the first bracket are substantially surrounded on three sides by the second bracket; and wherein each of the third and fourth walls has a varying wall thickness, wherein the wall thickness of each of the third and fourth walls is thinner toward respective ends of each of the third and fourth walls and thicker in a respective middle of each of the third and fourth walls.

7. The guide of claim 6, wherein the shoe comprises a first wiper connected to a top of the shoe and configured to brush one or more surfaces of one of the one or more rails as the shoe moves upward along the one of the one or more rails and wherein the shoe further comprises a second wiper connected to a bottom of the shoe and configured to brush one or more surfaces of the one of the one or more rails as the shoe moves downward along the one of the one or more rails.

8. The guide of claim 7, wherein each of the first and second wiper comprises felt; and the felt is configured to brush one or more surfaces of the one of the one or more rails as the shoe moves upward and downward along the one of the one or more rails.

9. The guide of claim 7, wherein each of the first and second wiper comprises a plurality of bristles; and wherein the plurality of bristles are configured to brush one or more surfaces of the one of the one or more rails as the shoe moves upward and downward along the one of the one or more rails.

10. The guide of claim 6, wherein the shoe comprises a low-friction material, selected from a group of materials consisting of polyoxymethylene, polytetrafluoroethylene, and polyethylene.

11. The guide of claim 6, wherein the shoe comprises a plurality of grooves arranged longitudinally in one or more surfaces of the shoe configured to slide on one of the one or more rails.

12. The guide of claim 6, wherein the shoe comprises a tapered top portion configured to provide a graduated sliding connection to one of the one or more rails for movement in an upward direction, and wherein the shoe further comprises a tapered bottom portion configured to provide a graduated sliding connection to the one of the one or more rails for movement in a downward direction.

13. An elevator system comprising:

a car;

a frame connected to the car;

one or more rails; and one or more sliding guides connected to the frame and slidably connected to at least one of the one or more rails, each of the one or more sliding guides comprising:

a plurality of elastomeric members arranged generally from a first end of the sliding guide to a second end of the sliding guide and connected to a bracket connected to the frame along a first wall and to a shoe slidably connected to the at least one of the one or more rails along a second wall;

wherein the plurality of elastomeric members are configured for deflection under loads of increasing magnitude; and wherein one or more of the plurality of elastomeric members is generally tubular, and wherein:

(i) each of the generally tubular elastomeric members has a generally rounded-octagonal, tube-shaped cross-section with a contoured tube wall of varying thickness; or (ii) each of the generally tubular elastomeric members has a tube-shaped cross-section comprising:

a generally convex third wall; and a generally convex fourth wall; and wherein each of the third and fourth walls has a varying wall thickness, wherein the wall thickness of each of the third and fourth walls is thinner toward respective ends of each of the third and fourth walls and thicker in a respective middle of each of the third and fourth walls; or (iii) each of the generally tubular elastomeric members has a tube-shaped cross-section with a generally rectangular outer wall and a generally circular inner wall.

* * * * *